US006483404B1

(12) United States Patent
Ammar et al.

(10) Patent No.: US 6,483,404 B1
(45) Date of Patent: Nov. 19, 2002

(54) MILLIMETER WAVE FILTER FOR SURFACE MOUNT APPLICATIONS

(75) Inventors: Danny F. Ammar, Windermere, FL (US); Eugene Fischer, Clermont, FL (US)

(73) Assignee: Xytrans, Inc., Orlando, FL (US)

( * ) Notice: Subject to any disclaimer, the term of this patent is extended or adjusted under 35 U.S.C. 154(b) by 0 days.

(21) Appl. No.: 09/933,269

(22) Filed: Aug. 20, 2001

(51) Int. Cl.[7] ..... H01P 1/203
(52) U.S. Cl. ..... 333/204; 333/246
(58) Field of Search ..... 333/204, 205, 333/219, 246, 247

(56) References Cited

U.S. PATENT DOCUMENTS

| | | | | | |
|---|---|---|---|---|---|
| 3,745,489 | A | | 7/1973 | Cristal et al. | 333/70 |
| 4,701,727 | A | | 10/1987 | Wong | 333/204 |
| 4,899,118 | A | * | 2/1990 | Polinski, Sr. | 333/246 |
| 4,992,759 | A | | 2/1991 | Giraudeau et al. | 333/204 |
| 5,150,088 | A | * | 9/1992 | Virga et al. | 333/238 |
| 5,157,364 | A | * | 10/1992 | Pond et al. | 333/203 |
| 5,389,904 | A | * | 2/1995 | Tao et al. | 333/204 |
| 5,545,924 | A | | 8/1996 | Contolatis et al. | 257/724 |
| 5,552,752 | A | | 9/1996 | Sturdivant et al. | 333/243 |
| 5,619,399 | A | | 4/1997 | Mok | 361/707 |
| 5,631,446 | A | | 5/1997 | Quan | 174/254 |
| 5,729,433 | A | | 3/1998 | Mok | 361/704 |
| 6,041,245 | A | | 3/2000 | Mansour | 505/210 |
| 6,091,312 | A | * | 7/2000 | Sheen | 333/134 |
| 6,124,636 | A | | 9/2000 | Kusamitsu | 257/728 |
| 6,127,906 | A | * | 10/2000 | Brooks et al. | 333/175 |
| 6,130,189 | A | | 10/2000 | Matthaei | 505/210 |
| 6,205,032 | B1 | * | 3/2001 | Shepherd | 174/255 |
| 6,348,844 | B1 | * | 2/2002 | Albinsson et al. | 333/246 |

* cited by examiner

*Primary Examiner*—Seungsook Ham
(74) *Attorney, Agent, or Firm*—Allen, Dyer, Doppelt, Milbrath & Gilchrist, P.A.

(57) ABSTRACT

A millimeter wave filter for surface mount applications includes a dielectric base plate having opposing surfaces. A ground plane layer is formed on a surface of the dielectric base plate. At least one low temperature co-fired ceramic layer is positioned over the ground plane layer and defines an outer filter surface. A plurality of coupled line millimeter wavelength resonators are formed as stripline or microstrip and positioned on the outer filter surface. These resonators can be parallel coupled line filters, including hairpin resonators. Radio frequency terminal contacts are positioned on the surface of the dielectric base plate opposite the at least one low temperature co-fired ceramic layer. Conductive vias extend through the at least one low temperature co-fired ceramic layer, ground plane and dielectric base plate and interconnect the radio frequency terminal contacts and coupled line resonator.

25 Claims, 4 Drawing Sheets

28 GHz BAND-PASS FILTER

38 GHz BAND-PASS FILTER

28 GHz BAND-PASS FILTER

38 GHz BAND-PASS FILTER

MILLIMETER WAVE FILTER FOR SURFACE MOUNT APPLICATIONS

FIELD OF THE INVENTION

This invention relates to millimeter wave filters, and more particularly, this invention relates to millimeter wave filters such as parallel coupled line filters.

BACKGROUND OF THE INVENTION

High performance millimeter wave (MMW) filters have typically been designed and fabricated using thin film technology by techniques known to those skilled in the art. Any manufacturing techniques using thin film technology requires tight design tolerances to achieve a desired filter response at various millimeter wave frequencies. These tolerances include the necessary and critical dimensions concerning material thickness, surface roughness, dielectric constants, metallization thicknesses, and transmission line width and spacing.

In these prior art thin film filter designs, the filter length and filter width usually varied as a function of the frequency band because of the wavelength change. Any change in the filter length made it difficult to design a common radio frequency module layout across multiple frequency bands. Because these high frequency thin film technology filters have been expensive, they were usually fabricated separately and then attached as a bare semiconductor die to a carrier plate or directly to a housing using epoxy or solder.

As the millimeter wave industry has moved closer to implementing high volume surface mount manufacturing techniques, there has been a need for low cost surface mount filters that can be used at high frequency. It would be advantageous if low cost, high performance millimeter wave filters could be manufactured using one or more layers of thick film, low temperature co-fired ceramic technology (LTCC) with the associated lower manufacturing tolerances. Any millimeter wave filter using this technology would have to achieve high "Q" filters in small spaces.

Microstrip and stripline interface methods are possible approaches. Any filters manufactured using these low temperature co-fired ceramic materials should be desensitized to the traditional critical tolerances associated with thin film technology and compensate for any bandwidth and return loss degradation caused by wider tolerances that are associated with thick film technology. The advantages would be a filter that is produced at a fraction of the cost of thin film filters.

SUMMARY OF THE INVENTION

The present invention advantageously provides a high performance millimeter wave filter using low temperature co-fired ceramic thick film technology. It achieves high "Q" filters in a small space by vertically stacking resonators in a multilayer low temperate co-fired ceramic film. These resonators can form parallel coupled line filters, including a hairpin filter. Microstrip and stripline interface connections are used to stack the filters in the low temperature co-fired ceramic layers, allowing the structure to be used for standard surface mount packages. The filters are desensitized to traditional critical tolerances associated with thin film technology and compensate for bandwidth and return loss degradation caused by wider tolerances associated with the thick film technology. These type of filters can be manufactured for high performance capabilities at a fraction of the cost of thin film filters. Additionally, these filters, including hairpin filters, can eliminate filter size variation versus frequency and reduce the size of the filter by fifty percent.

In accordance with one aspect of the present invention, the millimeter wave filter for surface mount applications includes a dielectric base plate having opposing surfaces. A ground plane layer is formed on a surface of the dielectric base plate. At least one low temperature co-fired ceramic layer is positioned over the ground plane layer and defines an outer filter surface. A plurality of coupled line millimeter wavelength resonators, such as parallel coupled resonators, including hairpin resonators, are formed as stripline or microstrip and positioned on the outer filter surface.

Radio frequency terminal contacts are positioned on the surface of the dielectric base plate opposite the at least one low temperature co-fired ceramic layer. Conductive vias extend through the at least one low temperature co-fired ceramic layer, ground plane and dielectric base plate and each interconnect radio frequency terminal contacts and at least one coupled line resonator.

In yet another aspect of the present invention, a lower ground plane layer is positioned on the surface of the dielectric base plate opposite the ground plane and the ceramic layer and isolated from the radio frequency terminal contacts. A plurality of isolation vias extend through the low temperature co-fired ceramic layer and dielectric base plate and engage the lower ground plane layer.

In still another aspect of the present invention, a plurality of low temperature co-fired ceramic layers and interposed ground plane layers form a multilayer low temperature co-fired ceramic substrate board. A plurality of millimeter wavelength stripline resonators are formed on the ceramic layers between the outer filter surface and dielectric base plate and isolated by the interposed ground plane layers. In one non-limiting example, these resonators are hairpin resonators. Conductive vias interconnect resonators formed on the ceramic layers and outer filter surface. The resonators can form two-pole hairpin filters and can be about one-quarter wavelength long. A dielectric cover is positioned over the outer filter surface and has a metallized interior surface spaced from the hairpin resonators for generating a predetermined cut-off frequency. This dielectric cover is spaced about 15 to about 25 mils distance from the resonators formed on the upper filter surface. Resonators formed on the outer filter surface can be formed as microstrip.

In another aspect of the present invention, the dielectric base plate is formed from a ceramic material, such as an aluminum oxide, which is about 10 to about 35 mils thick.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention is advantageous and provides an improvement over the traditional high frequency millimeter wave filters that have been fabricated using thin film technology requiring tight design tolerances to achieve a desired filter response at millimeter wave frequencies. The present invention allows the production of low cost, high performance millimeter wave filters, including a desired parallel coupled line filter, including a hairpin filter, which is designed and manufactured using conventional thick film low temperature co-fired ceramic technology, allowing looser tolerances. This is advantageous over prior art thin film technology, which had close and tight tolerances, including tolerances for material thickness, surface roughness, dielectric constant, metallization thickness and transmission line width and spacing. The present invention allows the production of hairpin and similar parallel coupled line filters with low temperature co-fired ceramic technology. The present invention is desensitized to traditional critical tolerances associated with the prior art thin film technology and can be easily packaged in miniature surface mount packages for ease of assembly and test.

The present invention achieves high performance millimeter wave filters using the standard low temperature co-fired ceramic thick film technology and achieves high "Q" filters in a small space by vertically stacking resonators in a multilayer, low temperature co-fired ceramic film. Microstrip and stripline interface circuits and associated manufacturing methods are advantageous and are used to stack filters in low temperature co-fired ceramic layers for use as standard surface mount packages. Millimeter wave filters can be designed and manufactured and desensitized to traditional. These critical tolerances associated with more common thin film technology. Bandwidth and return loss degradation can be compensated. These high performance low temperature co-fired ceramic filters can be obtained at a fraction of the cost of thin film filters. Any filter designs, such as the non-limiting hairpin filter, can eliminate filter size variation versus frequency and reduce the size of the filter by fifty percent.

Figure 1A:
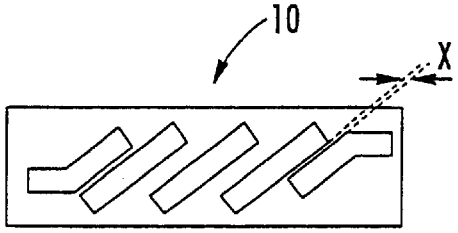
FIG. 1A. (PRIOR ART)
FIGS. 1A and 1B show typical thin film threepole bandpass parallel-coupled line filters operating at 24 GHz and 38 GHz, respectively, and showing the difference in the length of the filter that is proportional to the change in radio frequency wavelength.
Figure 1B:
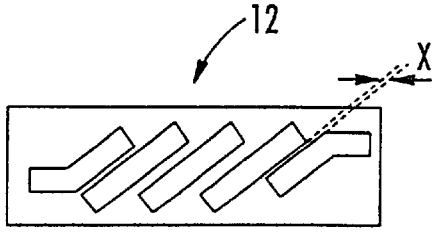
FIG. 1B. (PRIOR ART)

FIGS. 1A and 1B show examples of respective 28 GHz and 38 GHz bandpass filters 10,12 that have been manufactured as conventional thin film three-pole bandpass, parallel-coupled line filters operating at those respective frequencies. The difference in the length of the filter is proportional to the change in radio frequency wavelength. As is known to those skilled in the art, to achieve wide bandwidths, these types of thin film filters require large capacitance values and require a gap between the resonators that is extremely small, about one mil, as shown by the dimension "X" in both FIGS. 1A and 1B. These filters are expensive to manufacture because of the high cost associated with thin film material and processing. The dimension labeled "X" in FIG. 1B illustrates a 0.001 inch (one mil) spacing as described in the present thin film filter example.

Figure 2A:
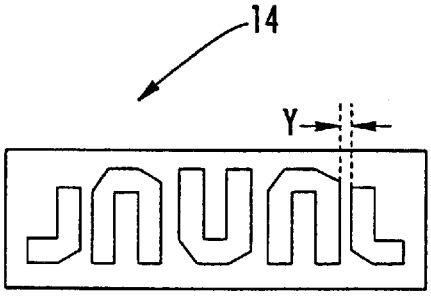
FIGS. 2A and 2B show three-pole filters made of thick film low temperature co-fired ceramic material (LTCC) as an example of the spacing associated with LTCC technology.
Figure 2B:
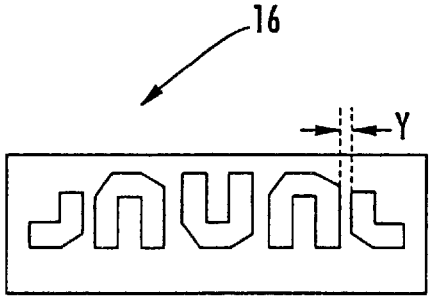

FIGS. 2A and 2B illustrate as non-limiting examples of the present invention, three-pole hairpin filters 14,16 for respective 28 GHz and 38 GHz bandpass filters with representative resonator spacing dimensions "Y" to compare with the prior art dimension "X", and showing differences in filter design for the present invention as manufactured from thick film low temperature co-fired ceramic material. Although hairpin filters are illustrated and described, the present invention is applicable for most parallel coupled line filters, using vertical stacking of low temperature co-fired ceramic material. As illustrated, the spacing "Y" is not as close as in the more traditional thin film bandpass filter as shown in FIGS. 1A and 1B for the dimension "X". The spacing in the low temperature co-fired ceramic bandpass filter, shown in FIGS. 2A and 2B, is about 0.003 inches (3 mil) as compared to 0.001 inch (1 mil) for the thin film technology. The ability to use wider spacing between the resonators (3 mil versus 1 mil) is advantageous because the present invention can adapt the use of lower cost screen printing of the resonators versus the high cost of metal etching used with thin film technology to achieve 1 mil tolerance. In some processes, 3 mil spacing is about the limit of screen printing capabilities.

Hairpin bandpass filters use capacitively coupled resonators similar to widely used parallel-coupled line bandpass filters (BPF). As is known to those skilled in the art, two types of hairpin filters are used: (1) the coupled line input filter, as used mainly in narrow band applications; and (2) the tapped input hairpin filter, as mainly used in wideband applications. A hairpin filter can be viewed as a parallel, coupled-line filter that has been folded back on itself as known to those skilled in the art. When folding the parallel-coupled lines, the result is a larger number of coupled lines for the same order of filter because of additional coupling between the lines forming the hairpin bends.

Some of the key parameters that must be ascertained and accounted for in the design of these filters in thick film low temperature co-fired ceramic material include the number of elements or resonators, the required out-of-band rejection, the substrate dielectric, the material height, the metallization thickness, the loss tangent and metal loss factor. One step in deriving the design is to convert low-pass prototype values into even and odd mode impedances, where corresponding impedances are then converted into physical dimensions for line widths and gaps for microstrip.

Any filters, such as hairpin filters, which are designed and manufactured using the low temperature co-fired ceramic material can be manufactured to about half the size of parallel-coupled line filters that are manufactured from more traditional approaches. A three-pole filter can be fabricated in less than 100-mil by 100-mil space. Any filters can have identical length for all frequency bands and have no tight tolerances as in the filters designed and manufactured using thin film technology. Any expected performance degradation caused by wider tolerances associated with thick film technology processing are compensated for by increasing the internal impedance of the filter and changing the line widths and gaps of the resonators.

At design frequency, the coupled line sections in the filter, as illustrated in this one non-limiting example hairpin filter, are a quarter wavelength. This type of filter takes more time to synthesize than regular filters and requires typically advanced radio frequency design software. As noted before, these filters can be designed and fabricated on thick film low temperature co-fired ceramic material at millimeter wave frequencies with excellent performance.

Figure 3:
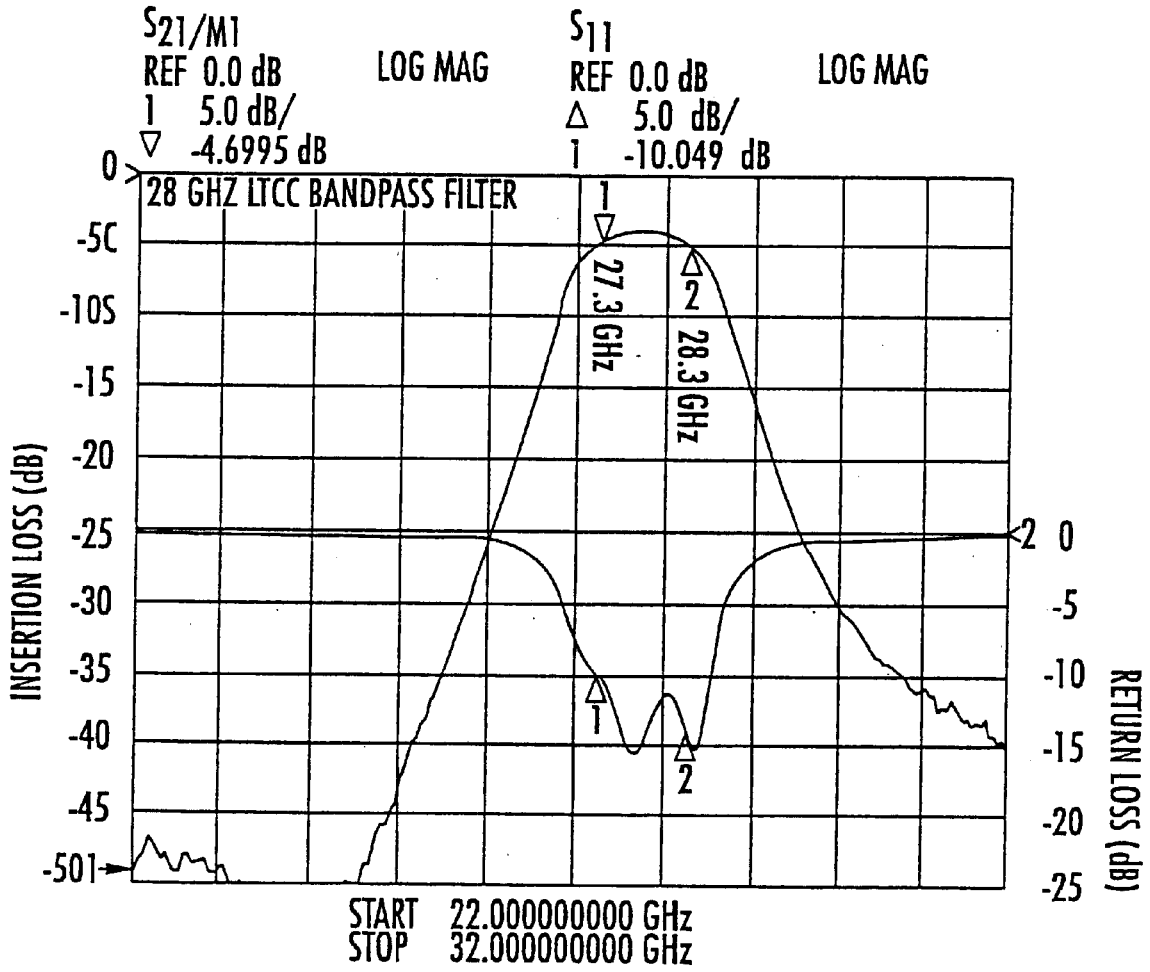
FIG. 3 is a graph showing a filter response for an exemplary low temperature co-fired ceramic three-pole filter response of the present invention.

FIG. 3 illustrates a filter response for a 28 GHz filter with 3% bandwidth and showing the insertion loss in decibels and the return loss in decibels on the vertical axis for a low temperature co-fired ceramic bandpass filter operable at 28 GHz. A start figure is shown at 22 GHhz and a stop figure is shown at 32 GHz, illustrating the low temperature co-fired ceramic three-pole filter response.

Figure 4:
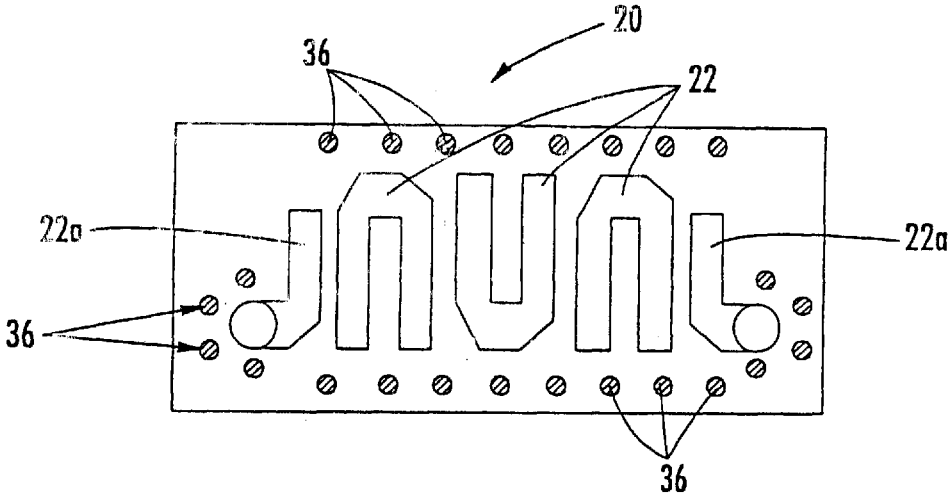
FIG. 4 is a fragmentary, plan view of a LTCC filter of the present invention that can be used in a surface mount package configuration.
Figure 5:
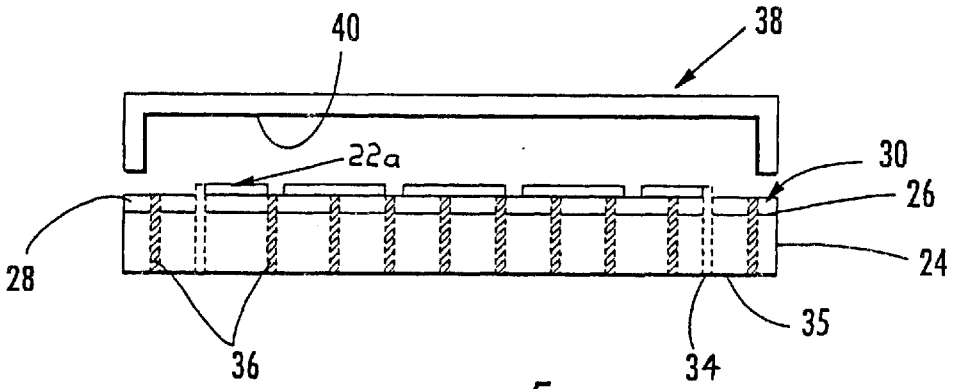
FIG. 5 is a fragmentary, sectional view of the filter shown in FIG. 4, and formed with an exemplary alumina carrier plate, a layer of low temperature co-fired ceramic tape, and a ground layer.
Figure 6:
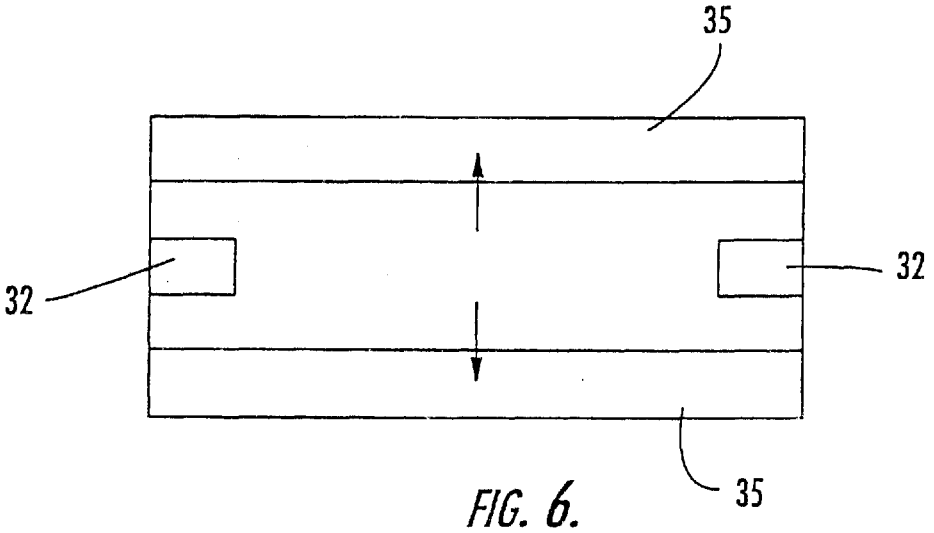
FIG. 6 is a fragmentary, bottom plan view of the filter shown in FIG. 4.

Referring now to FIGS. 4–6, there is illustrated the basic hairpin filter structure produced from the method of the present invention by creating hairpin filters to be used as a surface mount package configuration using thick film, low temperature co-fired ceramic materials. Naturally, the present invention is not limited to hairpin filters, but is applicable to other parallel coupled line filters. The description will proceed with reference to the illustrated, non-limiting example of hairpin filters. FIG. 4 shows an exemplary hairpin filter as in FIGS. 2A and 2B, and formed as a two-pole filter 20 with individual hairpin resonators 22. The filter is made in this particular embodiment using an alumina carrier plate 24 that is about 25 mil thick, in one non-limiting example, and acts as a dielectric base plate having opposing surfaces. A ground plane layer 26 is formed on a surface of the dielectric base plate 24. A low temperature co-fired ceramic layer 28 is positioned over the ground plane layer 26 and defines an outer ilter surface 30. This low temperature co-fired eramic layer 28 is in the illustrated embodiment formed of a layer of low temperature co-fired ceramic tape 28, which could also be Low Temperature Transfer Tape (LTTT) formed as green tape. It is formed about 5 to about 7 mils thick with a ground plane layer separating the dielectric base plate and the green tape layer.

A plurality of coupled line millimeter wavelength hairpin resonators 22 are formed as either stripline or microstrip and positioned on the outer filter surface 30. Radio frequency terminal contacts 32 are positioned on the surface of the dielectric base plate opposite the low temperature co-fired ceramic layer 28 formed from the green tape. As illustrated, conductive vias 32 extend through the low temperature co-fired ceramic layer 28, ground plane layer 26, and dielectric base plate, i.e., carrier plate 24, and each interconnect the radio frequency terminal contacts 32 and the end positioned coupled line resonators 22*a* formed on the outer filter surface 30.

In one aspect of the invention, the dielectric base plate is formed about 10 to about 35 mils thick (and preferably in one aspect about 25 mils thick) and formed from alumina, also known as aluminum oxide, a well known ceramic dielectric material. Other dielectric materials could be used as suggested by those skilled in the art.

As shown in FIG. 6, a lower ground plane layer 35 is positioned on the surface of the dielectric base plate 24 opposite the upper positioned ground plane layer 26 and the green tape layer 28 and isolated from the radio frequency terminal contacts as illustrated by the two parallel formed lines. A plurality of isolation vias 36 extend through the low temperature co-fired ceramic (green tape) layer 28 and dielectric base plate 24 and substantially engage the parallel strips forming lower ground plane layer 35. As shown in FIG. 4, the isolation vias 36 isolate the formed hairpin filter. A dielectric cover 38 can be positioned over the outer filter surface 30. This cover 38 has a metallized interior surface 40, such as formed from gold layer or similar material, that is spaced from the hairpin resonators 22 for generating a predetermined cut-off frequency. This cover 38 also shields the formed filter from outside interference. The distance between the microstrip and the top of the cover is about 20 mils, but can vary depending on what is required by one skilled in the art. If the filter is made of stripline only, a cover 38 will not usually be required.

Figure 7:
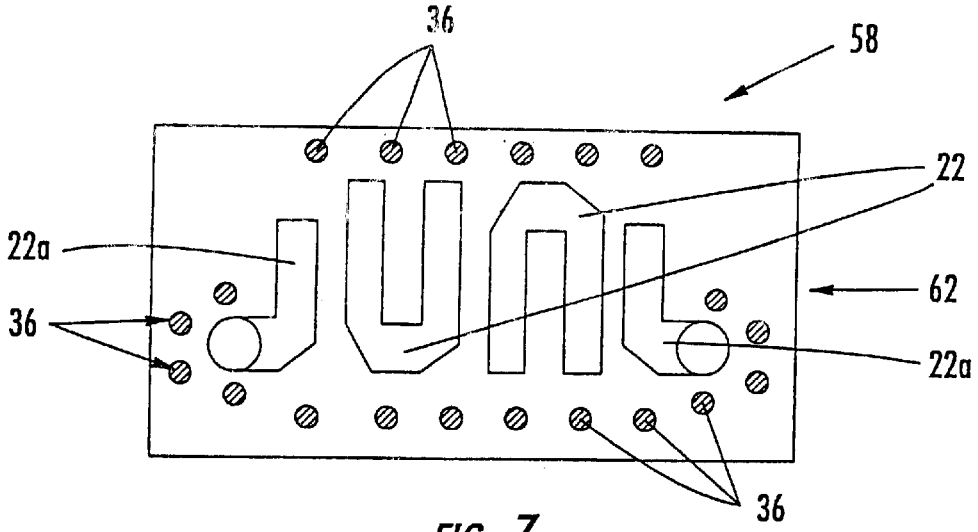
FIG. 7 is a fragmentary, plan view of a multilayer six-pole filter that is created by cascading three two-pole filters in different LTCC layers.
Figure 8:
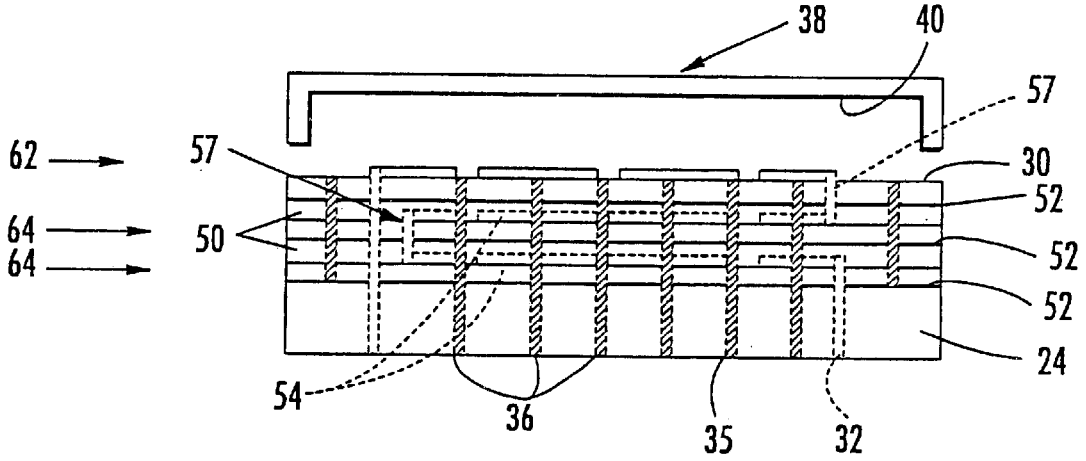
FIG. 8 is a fragmentary, sectional view of the filter shown in FIG. 7 and low temperature co-fired ceramic material positioned in stacked layers.
Figure 9:
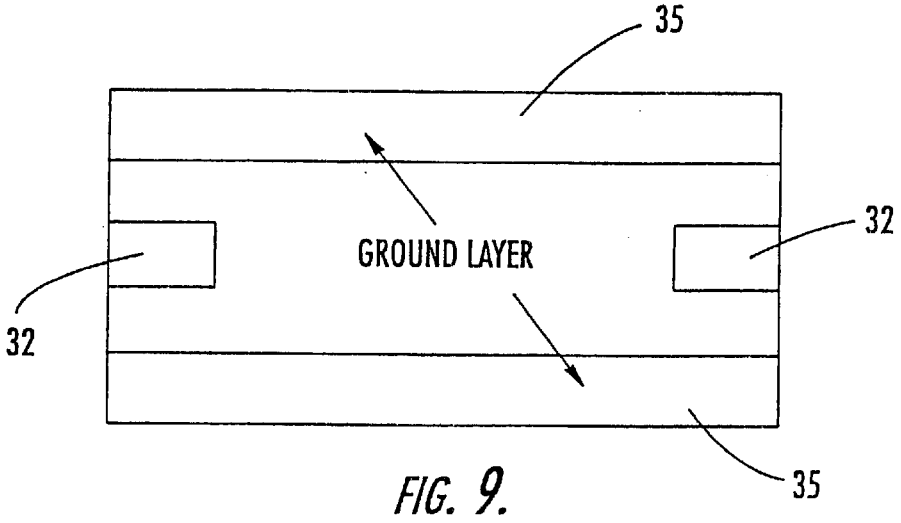
FIG. 9 is a fragmentary, bottom plan view of the filter shown in FIG. 7.

FIGS. 7–9 illustrate another embodiment of the present invention where a plurality of green tape layers 50 are formed as low temperature co-fired ceramic layers and positioned over the first ground plane layer. Intervening ground plane layers 52 are positioned between green tape layers 50. This plurality of low temperature co-fired ceramic layers 50 that are formed as green tape and the interposed ground plane layers 52 form a multilayer low temperature co-fired ceramic substrate board. A plurality of millimeter wavelength stripline hairpin resonators 54 are formed on the ceramic layers 50 between the outer filter 30 surface and the dielectric base (carrier) plate 24 and isolated by the interposed ground plane layers 52. As illustrated, conductive vias 57 interconnect the hairpin resonators 56 formed on the ceramic layers and outer filter surface. This configuration illustrates a multilayer, six-pole filter 58, which is created by cascading three two-pole filters in three different layers, with one microstrip filter 62 and two stripline filters 64, as illustrated.

These filters can have a nominal size of about 150 mil by about 100 mil and can be fabricated on large, six inch single layer or multilayer wafers and cut to size with an appropriate laser. The alumina cover 38 having the metallized interior surface can be attached to the filter using conductive silver epoxy. Where the top filter resonators are made of stripline only, a cover will not be required.

It is evident that the present invention is advantageous and provides for a surface mount millimeter wave thick film low temperature co-fired ceramic filter that is advantageous over the prior art. It can be formed with single or multilayer green tape or similar dielectric ceramic layers, with appropriate ground plane layers.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A millimeter wave filter for surface mount applications comprising:

a dielectric base plate having opposing surfaces;

a ground plane layer formed on a surface of the dielectric base plate;

at least one low temperature co-fired ceramic layer positioned over the ground plane layer and defining an outer filter surface;

a plurality of coupled line millimeter wavelength resonators formed as stripline or microstrip and positioned on the outer filter surface;

radio frequency terminal contacts positioned on the surface of the dielectric base plate opposite the at least one low temperature co-fired ceramic layer; and conductive vias extending through the at least one low temperature co-fired ceramic layer, ground plane layer and dielectric base plate and each interconnecting said radio frequency terminal contacts and a coupled line resonator.

2. A millimeter wave filter according to claim 1, and further comprising a lower ground plane layer positioned on the surface of the dielectric base plate opposite the ground plane layer and at least one low temperature co-fired ceramic layer and isolated from said radio frequency terminal contacts, and a plurality of isolation vias extending through said low temperature co-fired ceramic layer and dielectric base plate and engaging said lower ground plane layer.

3. A millimeter wave filter according to claim 1, and further comprising a plurality of low temperature co-fired ceramic layers and interposed ground plane layers to form a multilayer low temperature co-fired ceramic substrate board, and a plurality of millimeter wavelength stripline resonators formed on ceramic layers between said outer filter surface and dielectric base plate and isolated by said interposed ground plane layers, and conductive vias interconnecting said resonators formed on said ceramic layers and outer filter surface.

4. A millimeter wave filter according to claim 3, wherein said resonators form two-pole parallel coupled hairpin filters.

5. A millimeter wave filter according to claim 4, wherein said hairpin resonators are about one-quarter wavelength long.

6. A millimeter wave filter according to claim 1, and further comprising a dielectric cover positioned over said outer filter surface and having a metallized interior surface spaced from said resonators for generating a predetermined cut-off frequency.

7. A millimeter wave filter according to claim 6, wherein said dielectric cover is spaced about 15 to about 25 mils distance from the resonators formed on the outer filter surface.

8. A millimeter wave filter according to claim 6, wherein said resonators formed on said outer filter surface comprise resonators formed as microstrip.

9. A millimeter wave filter according to claim 1, wherein said dielectric base plate is formed from a ceramic material.

10. A millimeter wave filter according to claim 9, wherein said dielectric base plate is formed from aluminum oxide.

11. A millimeter wave filter according to claim 9, wherein said dielectric base plate is formed about 10 to about 35 mils thick.

12. A millimeter wave filter according to claim 1, wherein said at least one low temperature. co-fired ceramic layer is formed about 5 to about 7 mils thick.

13. A millimeter wave filter for surface mount applications comprising:

a dielectric base plate having opposing surfaces;

a ground plane layer formed on a surface of the dielectric base plate;

at least one low temperature co-fired ceramic layer positioned over the ground plane layer and defining an outer filter surface;

a plurality of coupled line millimeter wavelength resonators formed as microstrip and positioned on the outer filter surface;

radio frequency terminal contacts positioned on the surface of the dielectric base plate opposite the at least one low temperature co-fired ceramic layer;

conductive vias extending through the at least one low temperature co-fired ceramic layer, ground plane layer and dielectric base plate and each interconnecting said radio frequency terminal contacts and a coupled line resonator;

a lower ground plane layer positioned on the opposing surface of the dielectric base plate opposite the low temperature co-fired ceramic layer and isolated from said radio frequency terminal contacts, and a plurality of isolation vias extending through at least one said low temperature co-fired ceramic layer and dielectric base plate and engaging said lower ground plane layer; and a dielectric cover positioned over said outer filter surface and having a metallized interior surface spaced from said millimeter wavelength resonators for generating a predetermined cut-off frequency.

14. A millimeter wave filter according to claim 13, and further comprising a plurality of low temperature co-fired ceramic layers and interposed ground plane layers to form a multilayer low temperature co-fired ceramic substrate board, and a plurality of millimeter wavelength stripline resonators formed on ceramic layers between said outer filter surface and dielectric base plate and isolated by said interposed ground plane layers, and conductive vias interconnecting resonators formed on said ceramic layers and outer filter surface.

15. A millimeter wave filter according to claim 13, wherein said resonators form two-pole hairpin filters.

16. A millimeter wave filter according to claim 15, wherein said hairpin resonators are about one-quarter wavelength long.

17. A millimeter wave filter according to claim 16, wherein said dielectric cover is spaced about 15 to about 25 mils distance from the resonators formed on the outer filter surface.

18. A millimeter wave filter for surface mount applications comprising:

a dielectric base plate having opposing surfaces;

ground plane layer formed on a surface of the dielectric base plate;

a multilayer substrate board positioned on a surface of the dielectric base plate and formed from a plurality of low temperature co-fired ceramic layers and ground plane layers positioned between the low temperature co-fired ceramic layers, said multilayer substrate board defining an outer filter surface;

a plurality of coupled line millimeter wavelength hairpin resonators formed as stripline or microstrip and positioned on the outer filter surface;

a plurality of coupled line millimeter wavelength hairpin resonators formed as stripline on said ceramic layers;

conductive vias interconnecting at least one of said hairpin resonators formed on each of said ceramic layers and outer filter surface;

radio frequency terminal contacts positioned on the surface of the dielectric base plate opposite the multilayer substrate board; and conductive vias extending through the multilayer substrate board and dielectric base plate and each interconnecting said radio frequency terminal contacts and at least one coupled line hairpin resonator.

19. A millimeter wave filter according to claim 18, wherein said hairpin resonators at each layer and outer filter surface each form a two-pole hairpin filter.

20. A millimeter wave filter according to claim 18, and further comprising a lower ground plane layer positioned on the opposing surface of the dielectric base plate opposite the multilayer substrate board and isolated from said radio frequency terminal contacts, and a plurality of isolation vias extending through said substrate board and dielectric base plate and engaging said lower ground plane layer.

21. A millimeter wave filter according to claim 18, wherein said millimeter wavelength hairpin resonators are about one-quarter wavelength long.

22. A millimeter wave filter according to claim 18, and further comprising a dielectric cover positioned over said outer filter surface and having a metallized interior surface spaced from said hairpin resonators for generating a predetermined cut-off frequency.

23. A millimeter wave filter according to claim 22, wherein said dielectric cover is spaced about 15 to about 25 mils distance from the resonators formed on the out filter surface.

24. A millimeter wave filter according to claim 22, wherein said hairpin resonators formed on said outer filter surface comprise resonators formed as microstrip.

25. A millimeter wave filter according to claim 18, wherein said coupled line hairpin resonators at each ceramic layer and on said,outer filter surface each comprise a two-pole filter.

* * * * *

UNITED STATES PATENT AND TRADEMARK OFFICE

CERTIFICATE OF CORRECTION

PATENT NO. : 6,483,404 B1
DATED : November 19, 2002
INVENTOR(S) : Ammar et al.

It is certified that error appears in the above-identified patent and that said Letters Patent is hereby corrected as shown below:

Column 5,
Line 42, delete “ilter” substitute -- filter --
Line 43, delete “eramic” substitute -- ceramic --

Column 10,
Line 6, delete “out” substitute -- outer --

Signed and Sealed this

Twenty-fifth Day of February, 2003

JAMES E. ROGAN
*Director of the United States Patent and Trademark Office*